US007086106B1

(12) United States Patent
Hairston

(10) Patent No.: US 7,086,106 B1
(45) Date of Patent: Aug. 8, 2006

(54) STRETCHER PAD AND METHOD OF USE THEREOF

(76) Inventor: Celento Hairston, 7507 Waters Edge Dr., Stone Mountain, GA (US) 30087

( * ) Notice: Subject to any disclaimer, the term of this patent is extended or adjusted under 35 U.S.C. 154(b) by 0 days.

(21) Appl. No.: 11/104,052

(22) Filed: Apr. 12, 2005

(51) Int. Cl.
*A47C 31/00* (2006.01)
*A47G 9/00* (2006.01)

(52) U.S. Cl. ..... 5/691; 5/640; 5/663; 5/690; 5/922; 5/81.1 R

(58) Field of Classification Search ..... 5/691, 5/690, 663, 922, 640, 923, 482, 485, 81.1 R, 5/430
See application file for complete search history.

(56) References Cited

U.S. PATENT DOCUMENTS

| | | | | |
|---|---|---|---|---|
| 2,641,779 | A | 6/1953 | Gill | |
| 3,742,530 | A | 7/1973 | Clark | |
| 4,370,765 | A | 2/1983 | Webber | |
| 4,572,174 | A | 2/1986 | Eilender et al. | |
| 4,827,545 | A | 5/1989 | Arp | |
| 4,924,543 | A * | 5/1990 | Hoss et al. | 5/484 |
| 4,941,222 | A * | 7/1990 | Prager | 5/111 |
| 5,044,025 | A | 9/1991 | Hunsinger et al. | |
| 5,118,553 | A | 6/1992 | Boisson | |
| 5,146,641 | A | 9/1992 | Zwickey | |
| 5,175,897 | A | 1/1993 | Marra, Jr. | |
| 5,345,627 | A * | 9/1994 | Cammarata | 5/419 |
| 5,450,641 | A | 9/1995 | Montgomery | |
| 5,557,817 | A | 9/1996 | Haddock | |
| 5,575,025 | A | 11/1996 | Peters | |
| 5,644,807 | A * | 7/1997 | Battistella | 5/419 |
| D382,164 | S | 8/1997 | Hays | |
| 5,675,851 | A | 10/1997 | Feathers | |
| 5,699,568 | A | 12/1997 | Couldridge | |
| 5,890,244 | A | 4/1999 | Cartwright et al. | |
| 5,911,654 | A | 6/1999 | Webb | |
| 6,453,492 | B1 | 9/2002 | Sturrock | |
| 6,481,736 | B1 * | 11/2002 | Chan | 280/288.4 |
| 6,484,335 | B1 | 11/2002 | Gilbert | |
| 2004/0003469 | A1 | 1/2004 | Gill-Barajas | |

* cited by examiner

*Primary Examiner*—Alexander Grosz
(74) *Attorney, Agent, or Firm*—Williamson Intellectual Property Law, LLC; Thomas R. Williamson III

(57) ABSTRACT

An improved stretcher pad and method of use thereof, wherein the improved stretcher pad comprises a cushioned pad with wing members extending therefrom, and wherein the wing members comprise pockets dimensioned to receive the side rails of a stretcher or gurney. Once inserted into the wing members, a side rail can be folded to form a bridge support between the stretcher and/or gurney and a patient's bed or other surface upon which the patient reposes. A removable, adjustable pillow is also included.

5 Claims, 2 Drawing Sheets

STRETCHER PAD AND METHOD OF USE THEREOF

TECHNICAL FIELD

The present invention relates generally to stretchers, and more specifically to an improved stretcher pad having side wing sections adapted to accommodate and pad the side rails of a stretcher or gurney.

BACKGROUND OF THE INVENTION

When transporting a patient from the place of his/her injury to a transport vehicle, or when moving a patient to/from his/her bed, a stretcher or gurney is often utilized. Such stretchers or gurneys are typically lightweight support devices capable of being rolled, wherein a patient is placed on top of the stretcher or gurney and transported thereby.

In order to provide comfort to a patient, the stretcher or gurney typically has a pad placed on the surface thereof. The pad typically covers the entire top surface of the stretcher or gurney to provide the patient with a comfortable platform while being moved.

The stretcher or gurney typically has side rails that can be raised or lowered to provide side restraints to prevent the patient from rolling or falling off the stretcher or gurney. To provide the requisite structural integrity, the stretcher or gurney, along with the side rails thereof, is often formed of metal. As such, when a patient is transported within such stretchers, he/she may roll and contact the raised side rails thereof; thus, resulting in discomfort or minor injury.

Furthermore, because such side rails can be folded or adjusted to lay in a horizontal position and, thus, provide a bridging section between the stretcher and a bed, great discomfort can occur when moving a patient across the bridging metal side rail due to a lack of padding thereover.

As such, various pad devices exist to provide a measure of comfort to a patient. For instance, one such device comprises a protective cover for hospital bed rails that forms a cover over the rail, wherein the cover must be secured in place once installed. However the foregoing device must be assembled around the side rail after it is raised.

Another device comprises an unpadded protective cover for a gurney, wherein side portions of the cover merely drape over the raised gurney rails, thereby failing to provide any securing means to retain the protective cover in place, or any padded protection from the hard metallic rails.

Additionally, separate pads that slip over side rails of a bed have been utilized. However, such separate pads are unattached to the main stretcher pad and, thus, lacking an anchoring point to the main stretcher pad, cannot retain the main stretcher pad in place during patient movement. Further, such separate pads must inconveniently be individually secured once in position on the side rails of the bed or stretcher.

Therefore, it is readily apparent that there is a need for an improved stretcher pad and method of use thereof, wherein the stretcher pad includes foldable side wing extensions that readily accommodate and provide padding for the side rails of the stretcher without the need to secure the side wing extensions in place, and wherein the side wing extensions permit articulation of the side rails from a vertical to a horizontal position.

BRIEF SUMMARY OF THE INVENTION

Briefly described, in a preferred embodiment, the present invention overcomes the above-mentioned disadvantages and meets the recognized need for such a device by providing an improved stretcher pad and method of use thereof, wherein the improved stretcher pad has side wing sections with integral pockets provided therewith. The side wing sections extend from the main stretcher pad and fit over side rails of the stretcher as the side rails are raised. Pockets in the wing sections receive the side rails, thereby providing padding to the side rails, resulting in added comfort and security to the patient. Additionally, retention of the side wing sections on the side rails maintains the stretcher pad in position on the surface of the stretcher, preventing the pad from sliding off the stretcher under pressures exerted by movement of a patient.

The stretcher pad of the present invention can also selectively include a pillow, wherein the pillow is attached via suitable fasteners that permit adjustment of the pillow along the surface of the stretcher pad to accommodate patients of different heights.

According to its major aspects and broadly stated, the present invention in its preferred form is an improved stretcher pad and method of use thereof, wherein the stretcher pad provides comfort to a patient during transport and/or movement of the patient. Patients are typically on a stretcher or gurney while being transported in an emergency vehicle and then are moved onto a hospital bed. During transfer onto or off of the stretcher, it is often necessary to lift, slide or roll the patient to move the patient from the bed to the stretcher, or vice versa. The stretcher pad of the present invention permits the use of folding side rails to form a bridge between the stretcher and the bed, thereby permitting easy sliding or rolling of a patient therebetween. The stretcher pad comprises side wing extensions that substantially envelop and, thus, pad the rails of the stretcher so that when the rails are in the bridging position, movement of the patient across the side rails may be done with comfort.

More specifically, the present invention is an improved stretcher pad and method of use thereof, wherein the stretcher pad comprises padded wing sections disposed on the side edges thereof. The wing sections are integrally-formed with, and/or are flexibly attached to, the top surface of the stretcher pad, and extend outwardly therefrom. It will be recognized by those skilled in the art that the wing sections could extend from, and be attached to, the bottom surface of the pad, or from the middle of the pad side.

Because the wing sections are flexibly attached to the pad, the wing sections can be articulated upward by approximately 180 degrees to fold back onto the pad surface, wherein such folded wing sections facilitate storage of the stretcher pad. Alternately, the wing sections can also be articulated downward by approximately 180 degrees when the wing sections are formed extending from the bottom surface of the pad, thereby providing similar storage. The flexibility of the wing sections also provides ease of manipulation to facilitate insertion of the stretcher side rails into the pockets of the wing sections. Notably, the present invention permits selective positioning of the side rails between an upright and horizontal orientation, whilst maintaining the padded wing sections thereover; thus, providing a padded bridging section between a patient's bed and the stretcher.

Because the side rails are securely maintained within the pockets of the wing sections, the wing sections retain the stretcher pad firmly on the stretcher, preventing sliding of the stretcher pad during patient movement. Further, the padding within the pocket of the wing sections provides a soft cushioning surface to prevent patient injury when the side rails are up and the patient inadvertently strikes same.

Accordingly, a feature and advantage of the present invention is its ability to provide comfort and security to a patient being transported on a stretcher or gurney.

Another feature and advantage of the present invention is its ability to retain the stretcher pad in position on the stretcher or gurney during movement of a patient, even with one of the side rails removed or lowered out of the stretcher pad.

Still another feature and advantage of the present invention is its ability to provide a padded bridge between a stretcher and a patient's bed.

Yet another feature and advantage of the present invention is its ability to be folded for storage and/or transport.

Yet still another feature and advantage of the present invention is that the wing sections are integrally formed with the pad.

A further feature and advantage of the present invention is that it can be installed without the need for additional securing devices.

These and other features and advantages of the present invention will become more apparent to one skilled in the art from the following description and claims when read in light of the accompanying drawings.

BRIEF DESCRIPTION OF THE DRAWINGS

The present invention will be better understood by reading the Detailed Description of the Preferred and Selected Alternate Embodiments with reference to the accompanying drawing figures, in which like reference numerals denote similar structure and refer to like elements throughout, and in which.

DETAILED DESCRIPTION OF THE PREFERRED AND SELECTED ALTERNATIVE EMBODIMENTS

Figure 1:
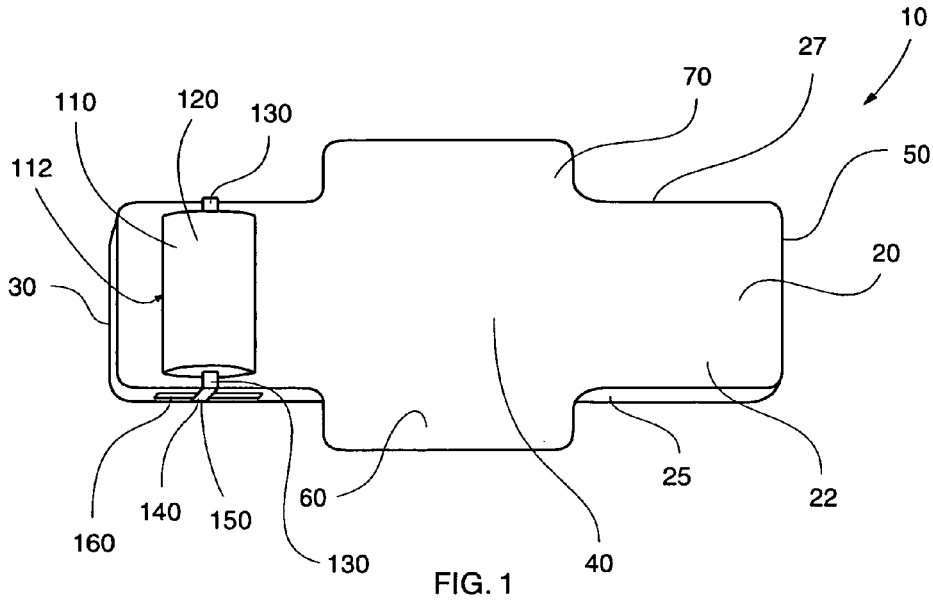
FIG. 1 is a top perspective view of an improved stretcher pad according to a preferred embodiment of the present invention.
Figure 2:
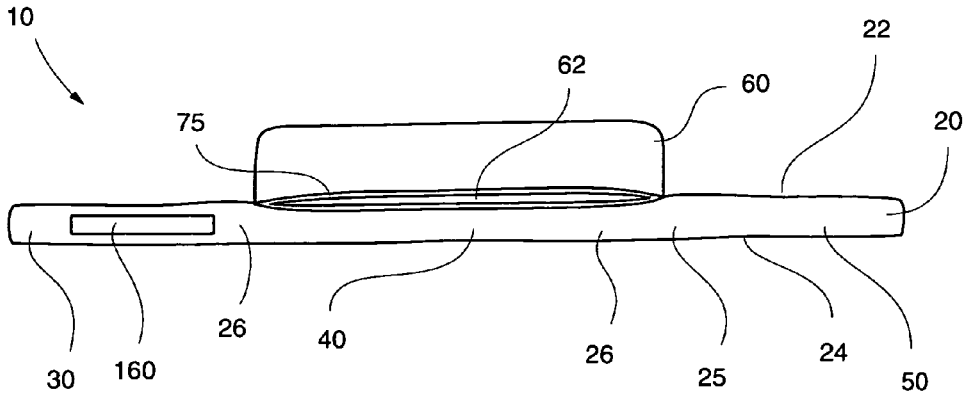
FIG. 2 is a side perspective view of an improved stretcher pad according to a preferred embodiment of the present invention.

In describing the preferred and selected alternate embodiments of the present invention, as illustrated in FIGS. 1–4, specific terminology is employed for the sake of clarity. The invention, however, is not intended to be limited to the specific terminology so selected, and it is to be understood that each specific element includes all technical equivalents that operate in a similar manner to accomplish similar functions.

Referring now to FIGS. 1–4, the present invention in a preferred embodiment is an improved stretcher pad 10 comprising main body 20, and wing members 60, 70. Main body 20 preferably comprises first side 25, second side 27, first end 30, middle 40 and second end 50. Main body 20 further preferably comprises top side 22, bottom side 24, first side center 26 and second side center 28.

First wing member 60 is preferably disposed on first side 25 of main body 20, extending from main body 20 at top side 22, preferably proximate middle 40. Second wing member 70 is preferably disposed on second side 27 of main body 20, extending from main body 20 at top side 22, preferably proximate middle 40. It will be recognized by those skilled in the art that first wing member 60 and second wing member 70 could be disposed at first side center 26 and second side center 28, respectively, or, in the alternative, wing members 60, 70 could extend from bottom side 24.

First wing member 60 preferably comprises pocket 62, and second wing member 70 preferably comprises pocket 72, wherein pockets 62, 72 are preferably dimensioned to receive side rails R of stretcher S. Pockets 62, 72 preferably comprise padding 75 therein, wherein padding 75 is disposed proximate side rails R, when side rails R are received by pockets 62, 72.

Figure 3:
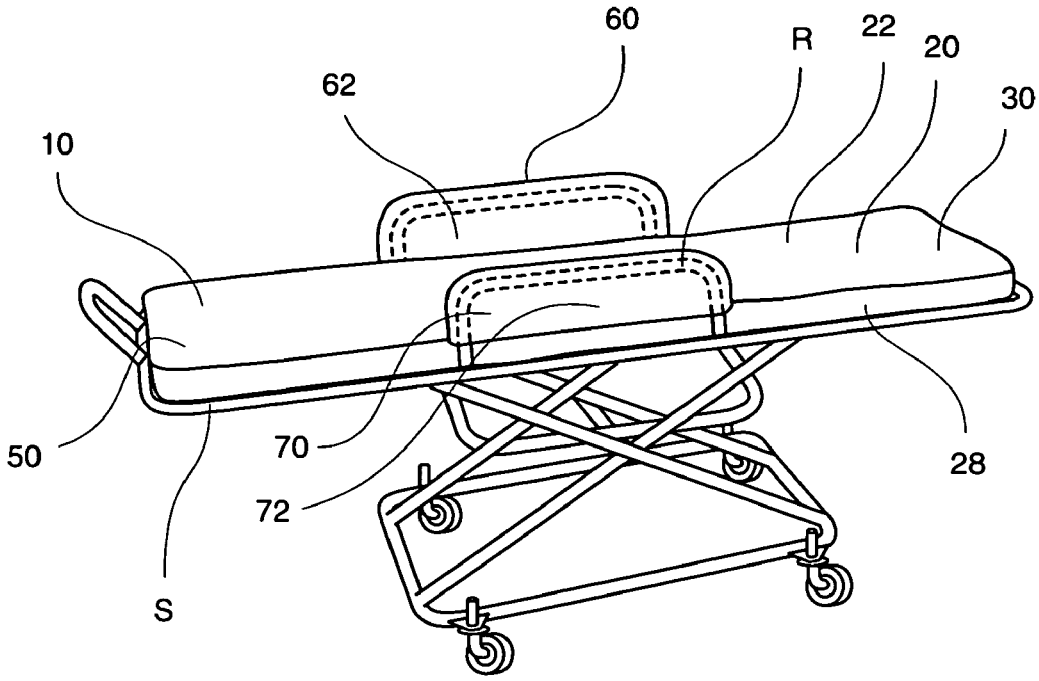
FIG. 3 is a perspective view of an improved stretcher pad according to a preferred embodiment of the present invention, shown installed on a stretcher; and, FIG. 4 is a perspective view of an improved stretcher pad according to a preferred embodiment of the present invention, shown in use to form a bridge to a patient's bed.

Referring now more particularly to FIG. 3, in use, improved stretcher pad 10 is preferably placed on stretcher S, wherein pockets 62, 72 of wing members 60, 70 are preferably engaged over or otherwise receive side rails R of stretcher S.

Figure 4:
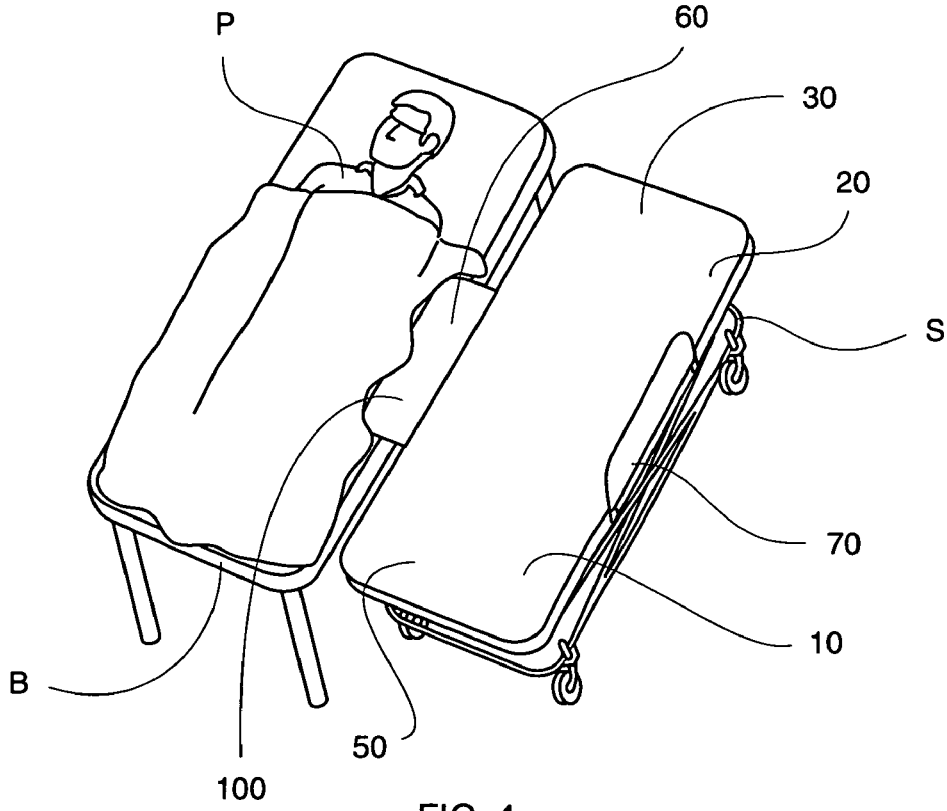

Referring now more particularly to FIG. 4, following receipt of side rails R within wing members 60, 70, one of wing members 60 or 70 may be folded down horizontally in such a fashion that side rail R, now padded by wing member 60 or 70, is preferably coplanar with main body 20, wherein padded side rail R preferably forms bridge section 100 suitable for bridging the gap between patient's bed B and stretcher S. Patient P can then be rolled or slid from bed B onto stretcher S and vice versa, wherein patient P is adequately and comfortably supported during transfer by padded bridge section 100.

Referring now again to FIG. 1, pillow 110 can be selectively utilized to provide additional comfort. Pillow 110 preferably comprises pad 120 and straps 130, wherein straps 130 comprise fasteners 140, such as, for exemplary purposes only, hook-and-loop fasteners, snap fasteners or belt-type fasteners. Fasteners 140 preferably comprise first component 150 and second component 160, wherein first component 150 is preferably disposed on strap 130 and second component 160 is preferably disposed on first side center 26 at first end 30 of stretcher pad 10. For exemplary purposes only, when first component 150 comprises hooks, and second component 160 comprises loops extending along first side center 26, pillow 110 can be selectively positioned by securing first component 150 anywhere along second component 160.

It is envisioned in an alternate embodiment of the present invention that second component 160 of hook-and-loop fastener 140 could be disposed on top side 22 of main body 20, and first component 160 of hook-and-loop fastener 140 could be disposed on underside 112 of pillow 110.

It is also envisioned in an alternate embodiment of the present invention that wing members 60, 70 could be detachable.

It is further envisioned in an alternate embodiment of the present invention that pillow 110 could be molded into main body 20.

It is further contemplated in an alternate embodiment of the present invention that main body 20 could have removable cover 90 to facilitate cleaning of same.

The foregoing description and drawings comprise illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains having the benefit of the teachings presented in the foregoing descriptions and the associated drawings. Although specific terms may be employed herein, they are used in a generic and descriptive sense only and not for purposes of limitation. Accordingly, the present invention is not limited to the specific embodiments illustrated herein, but is limited only by the following claims.

What is claimed is:

1. A pad adapted to be removably positioned on a gurney or stretcher that has laterally and generally centrally positioned siderails which are adapted to articulate from a vertical to a horizontal position, said pad comprising a generally rectangular main cushion body adapted to support a patient, and flexibly and generally centrally attached to at least one side of said main cushion body, a padded wing member comprising at least one pocket that is adapted to substantially envelop a sidewall of said gurney or stretcher, to thereby pad said side rail.

2. The pad of claim 1, further comprising a removable pillow.

3. The pad of claim 2, wherein said removable pillow comprises a first fastener component, and wherein said stretcher pad comprises a second fastener component, and wherein said first fastener component cooperatively engages said second fastener component.

4. The pad of claim 3, wherein said second fastener component extends laterally along a side of said main cushion body, whereby said removable pillow can be selectively adjusted.

5. The pad of claim 1, wherein said at least one wing member and said main cushion body are integrally formed.

* * * * *